United States Patent [19]

Blom

[11] Patent Number: 4,492,609

[45] Date of Patent: Jan. 8, 1985

[54] APPARATUS FOR SPLICING THE TRAILING END OF A WEB FROM AN EXHAUSTED SUPPLY ROLL TO THE LEADING END OF A WEB FROM A NEW SUPPLY ROLL

[75] Inventor: Friedrich Blom, Lengerich, Fed. Rep. of Germany

[73] Assignee: Windmöller & Hölscher, Lengerich, Fed. Rep. of Germany

[21] Appl. No.: 356,650

[22] Filed: Mar. 9, 1982

[30] Foreign Application Priority Data

Mar. 12, 1981 [DE] Fed. Rep. of Germany ..... 3109529

[51] Int. Cl.[3] ..... G03D 15/04; B31F 5/00; B32B 31/00; B26D 5/00

[52] U.S. Cl. ..... 156/507; 156/502; 156/510; 156/505; 156/361; 156/353; 242/58.4; 242/58.5

[58] Field of Search ..... 156/156, 157, 158, 159, 156/502, 504, 505, 510, 506, 507, 353, 361; 242/58.5, 58.4

[56] References Cited

U.S. PATENT DOCUMENTS

| | | | |
|---|---|---|---|
| 3,198,452 | 8/1965 | Buettel | 242/58.5 |
| 3,717,057 | 2/1973 | Takimoto | 156/502 |
| 3,939,031 | 2/1976 | Takimoto | 156/505 |
| 4,234,365 | 11/1980 | Shimizu et al. | 156/505 |
| 4,238,261 | 12/1980 | Tetro | 156/157 |

FOREIGN PATENT DOCUMENTS 2107677 10/1971 Fed. Rep. of Germany .

*Primary Examiner*—Edward C. Kimlin
*Assistant Examiner*—Merrell C. Cashion
*Attorney, Agent, or Firm*—Fleit, Jacobson, Cohn & Price

[57] ABSTRACT

Apparatus for splicing the trailing end of a web from an exhausted supply roll to the leading end of a web from a new supply roll comprises a cutting mechanism consisting of a cutter cylinder having a single cutter and a backing cylinder and serving to make a transverse severing cut through both superimposed webs passed between said cylinders, one of which is provided in a longitudinal strip- or sector-shaped portion with suction holes for retaining the leading end of the new web behind the severing cut. The apparatus also comprises a tape-applying cylinder, which is adapted to carry a tape which is adhesive on one side, and to apply the adhesive tape to the two webs at their abutting cut edges as they pass between the tape-applying cylinder. An outwardly facing adhesive tape is secured to the leading end of the web from the new supply roll and the backing cylinder which is associated with the cutter cylinder is adapted to be rotated at a peripheral velocity that is equal to the velocity of the web from the exhausted roll and to be moved into engagement with the new supply roll, which is adapted to be accelerated to the same peripheral velocity. The backing cylinder constitutes also the backpressure cylinder associated with the tape-applying cylinder, and means are provided for moving the cutter cylinder and the tape-applying cylinder into and out of engagement with the common backing cylinder.

11 Claims, 2 Drawing Figures

APPARATUS FOR SPLICING THE TRAILING END OF A WEB FROM AN EXHAUSTED SUPPLY ROLL TO THE LEADING END OF A WEB FROM A NEW SUPPLY ROLL

BRIEF DESCRIPTION OF THE DRAWINGS

This invention relates to apparatus for splicing the trailing end of a web from an exhausted supply roll to the leading end of a web from a new supply roll, comprising a cutting mechanism consisting of a cutter cylinder having a single cutter and a backing cylinder and serving to make a transverse severing cut through both superimposed webs passed between said cylinders, one of which is provided in a longitudinal strip- or sector-shaped portion with suction holes for retaining the leading end of the new web behind the severing cut, also comprising a tape-applying cylinder, which is adapted to carry a tape, which is adhesive on one side, and to apply the adhesive tape to the two webs at their abutting cut edges as they pass between the tape-applying cylinder and a backpressure cylinder.

Apparatus of that kind has been disclosed in German Patent Publication No. 21 07 677 and comprises a cutter cylinder, which cooperates with a backpressure cylinder, and a tape-applying cylinder, which cooperates with another backpressure cylinder. Each of the cutter and tape-applying cylinders has a flat so that they will not obstruct the movement of the web when the cylinders are in an inactive position. When it is desired to splice two webs, the leading end of the web from the new supply roll is inserted between the cutter cylinder and the backpressure cylinder so that said leading end lies above the web from the exhausted supply roll. The trailing end of the web from the exhausted supply roll is then held in position and the cylinders are rotated to their active position. The webs are then jointly severed and the adhesive tape is subsequently applied by the tape-applying cylinder to the joint which has been formed by the severing cut. The known apparatus can be manually operated but it has not been stated how the trailing end of a web from an exhausted roll could be fully automatically spliced to the leading end of a web from a new roll without a decrease of the velocity of the web.

SUMMARY OF THE INVENTION

It is an object of the invention to provide apparatus which is of the kind described first hereinbefore and can be used to fully automatically splice the trailing end of a web from an exhausted supply roll to the leading end of a web from a new supply roll without need for braking the web from the exhausted supply roll.

This object is accomplished according to the invention in that an outwardly facing adhesive tape is secured to the leading end of the web from the new supply roll and the backing cylinder which is associated with the cutter cylinder is adapted to be rotated at a peripheral velocity that is equal to the velocity of the web from the exhausted roll and to be moved into engagement with the new supply roll, which is adapted to be accelerated to the same peripheral velocity, the backing cylinder constitutes also the backpressure cylinder associated with the tape-applying cylinder, and means are provided for moving the cutter cylinder and the tape-applying cylinder into and out of engagement with the common backing cylinder.

Desirable further features of the invention will be recited in the dependent claims.

BRIEF DESCRIPTION OF THE DRAWINGS

Figure 1:
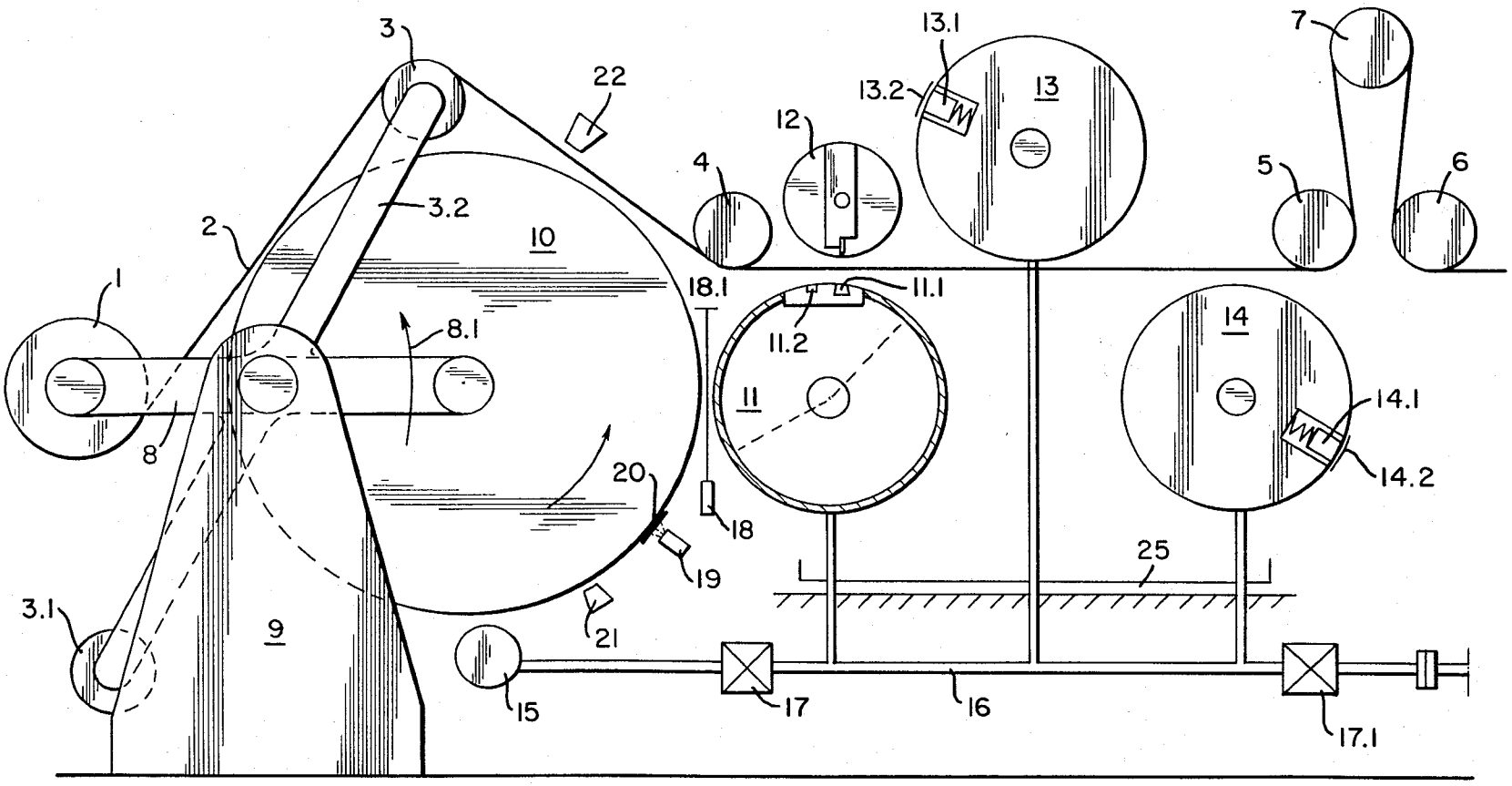

An illustrative embodiment of the invention will be explained more fully with reference to the drawing, in which FIG. 1 is a diagrammatic side elevation showing the apparatus in a condition in which the cutter cylinder, the tape-applying cylinder and the backing cylinder are disengaged from the web.

Figure 2:
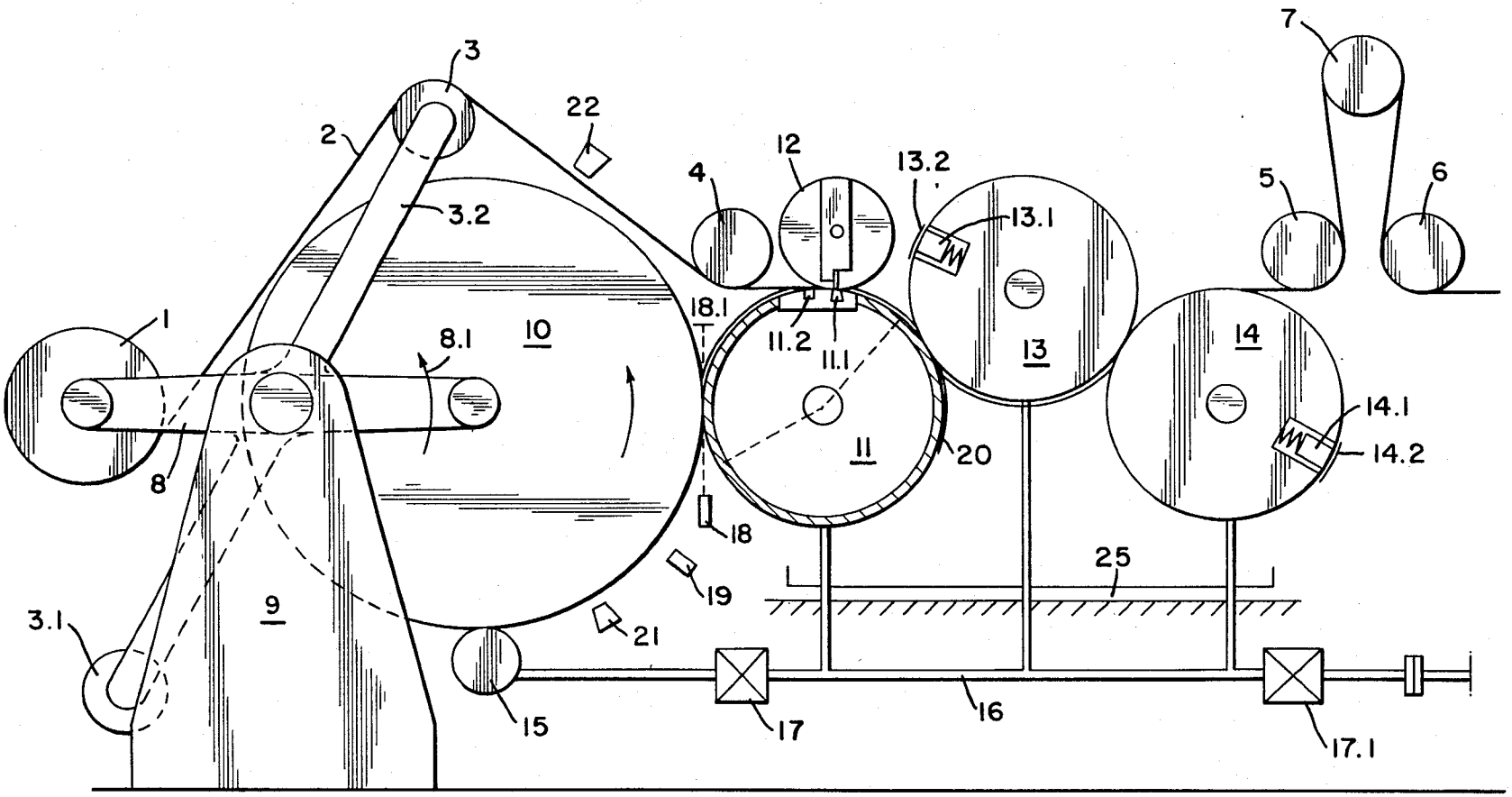

FIG. 2 is a view that is similar to FIG. 1 and shows the apparatus during the splicing of the leading end of the web from the new supply roll to the trailing end of the web from the exhausted supply roll.

DETAILED DESCRIPTION OF THE DRAWINGS

A web 2 is withdrawn from a supply roll 1 over guide rollers 3, 4, 5 and 6. A dancer roller 7 for tensioning the web 2 is disposed between the guide rollers 5 and 6. The supply roll 1 is rotatably mounted in known manner on a rotating spider 8, which is pivoted to a stand 9. The spider 8 carries also a new supply roll 10 in readiness. The guiding roller 4 is succeeded by a grooved cylinder 11, which is disposed beside the new supply roll 10 and formed with a cutting groove 11.1. A cutter cylinder 12 carrying a single cutter faces the grooved cylinder 11. The cylinders 11, 12 are succeeded by two tape-applying cylinders 13 and 14. The tape-applying cylinder 13 may be disposed above the web 2 and the tape-applying cylinder 14 below the web 2.

A drive roller 15 is provided, which extends parallel to the new supply roll 10 and can be moved into engagement with the periphery of the new supply roll 10 in known manner, not shown, in order to accelerate the new supply roll 10 to the velocity of the web 2.

The cylinders 11, 12, 13, and 14 mounted in a carriage 25, which is movable in the machine frame along horizontal tracks, and are driven just as the driver roller 15 by a main drive shaft 16. The rotation of the cutter cylinder 12 is so derived from the rotation of the grooved cylinder 11 that these two cylinders rotate at the same peripheral velocity.

The carriage 25 can be moved to engage the grooved cylinder 11 with new supply roll 10. The tape-applying cylinder 13 is adapted to be lowered in suitable tracks into engagement with the grooved cylinder 11 and the tape-applying cylinder 13.

The main drive comprises the main shaft 16 and differentials 17 and 17.1. By means of the differential 17, the phase relation of the drive roller 15 can be changed. The differential 17.1 serves to change the phase relation of the drive roller 15 and the cylinders 11, 13 and 14.

In dependence on the material of the web 2 from the supply roll 1, the latter and the new supply roll 10 are braked in known manner by disc or block brakes.

A series of suction holes or a suction slot 11.2 is formed in the grooved backing cylinder 11 and extends parallel to the cutting groove 11.1 thereof.

The tape-applying cylinders 13, 14 are provided with radially movable ribs 13.1, 14.1, which are retractable into the periphery or envelope of the cylinder. For splicing the butt joint on both sides, adhesive tapes 13.2 and 14.2 in a length that is equal to the width of the web 2 are applied to the ribs 13.1 and 14.1.

The carriage 25 carries a photoelectric detector 18, which is disposed in the gap between the new supply roll 10 and the grooved cylinder 11 and comprises a mirror 18.1, which defines an optical path which will be interrupted by the new supply roll 10 when the latter is contacted by the grooved cylinder 11.

The web on the new supply roll 10 is provided at its leading end with an adhesive tape 20 having an outwardly facing adhesive layer. A photosensor 19 is mounted on the periphery of the new supply 10 and detects the phase angle of the adhesive tape 20 on the new supply roll 10. The phase angle of the grooved cylinder 11 is sensed by a switch which delivers a signal, e.g., when the cutting groove 11.1 has reached the cutting position. The phase relation of the new supply roll 10 and of the grooved cylinder 11 is so controlled that when the grooved cylinder 11 is moved into engagement with the new supply roll 10 the adhesive tape 20 will not contact the cutting portion of the cylinder 11 so that the tape 20 will not be stuck into the cutting groove 11.1.

The cylinders 11, 13 and 14 mounted on the carriage 25 rotate in phase and when it is desired to splice the trailing end of the web from the exhausted supply roll to the leading end of the web from the new supply roll 10 said cylinders are driven at the same velocity as the web, just as the new supply roll 10.

The exhausted supply roll will be replaced by the new one when the spider 8 is in a horizontal position so that the axes of the new supply roll 10 and of the tape-applying cylinders 11, 14 lie in a common plane. The web from the supply roll 1 moves over the guide rollers 3 to 5 and does not contact the cylinders 11 to 14. A tachometer generator or a pulse generator is provided in known manner and serves to initiate the roll-changing operation when the speed of the exhausted supply roll 1 exceeds a predetermined limit. When the drive roll 15 has been swung into engagement with the new supply roll 10, the latter will be accelerated to the velocity of the web by the drive roller 15, which is driven from the main shaft 16. The differential 17 is operated to rotate the new supply roll 10 relative to the grooved cylinder 11 until the sensor 19 indicates that the proper phase relation has been reached. At the same time, the groove cylinder 11 is moved by the carriage 25 toward the new supply roll 10 and the tape-applying cylinder 13 is lowered to the position shown in FIG. 2, in which the cylinder 13 just contacts the grooved cylinder 11 and the tape-applying cylinder 14 so that the webs will be spliced at the butt joint. When the grooved cylinder 11 is sufficiently close to the new supply roll 10 and the adhesive tape 20 is moving past the grooved cylinder 11, the tape 20 will be applied to the grooved cylinder 11 at a distance from the cutting groove 11.1 and the leading end of the web from the new supply roll 10 will then be entrained by the grooved cylinder 11. The cutter cylinder 12 is mounted in eccentric members, which are rotated to move the cutter cylinder 12 to its cutting position so that the webs will be severed during the next passage of the cutter. To ensure that after the severing cut the new leading end of the web from the new supply roll 10 will not separate from the grooved cylinder 11, that new leading end is held on the grooved cylinder 11 in the suction zone 11.2.

As the abutting end portions formed by the cut move past the contacting regions of the cylinders 11, 13 and 13, 14, the ribs 13.1 and 14.1 are extended to apply the adhesive tapes 13.2 and 14.2 to the joint which has been formed by the cut so that the trailing end of the web from the exhausted supply roll is spliced on both sides to the leading end of the web from the new supply roll. It is apparent that the first splicing of the joint by the adhesive tape 13.2 is effected on the grooved cylinder 11 adjacent to the cutting groove 11.1. The opposite adhesive tape 14.2 is applied to the joint on the other side with the tape-applying cylinder 13 serving as a backing.

Immediately after the cutting operation the cutter cylinder 12 is raised to its initial position. The cylinders 11 and 13 return to their initial positions when the joint has been spliced.

The cut-off end portion of the web from the exhausted supply roll can be deflected upwardly between the cylinders 12 and 13 by a deflecting plate. The cut-off end portion of the web from the new supply roll 10 has been stuck on the grooved cylinder 11 and is removed from the latter by hand.

When the joint has been spliced, the new supply roll is swung in the direction of the arrow 8.1 to the position previously assumed by the supply roll 1. The guide roller 3 is rotatably mounted on a lever 3.2, which is connected to the spider 8 and has an extension in which another guide roller 3.1 is mounted.

The web 2 from the new supply roll 10 is thus guided like the one from the supply roll 1. The guiding roller 3 may be independently pivotally movable. In that case it must be swung through 360° also in the direction of the arrow 8.1 so that the guide roller 3 will guide the web from the new supply roll 10 as shown when the new supply roll 10 has been swung.

When it is desired to process printed webs, which should be spliced in perfect register, photocells 21, 22 may be provided on the new supply roll 10 and on the web 2 from the exhausted supply roll and the pulses from said photocells may be compared. Any register difference which has been detected can be eliminated in that the phase relation of the new supply roll and of the cylinders 11 to 14 is changed by means of the differential 18. The in-phase rotation of the new supply roll 10 and of the grooved cylinder 11 can be ensured by means of the differential 17, as described hereinbefore.

What is claimed is:

1. Apparatus for splicing the trailing end of a web from an exhausted supply roll to the leading end of a web from a new supply roll with the leading end having an outwardly facing adhesive, said apparatus comprising:

a cutter cylinder having a single cutter adapted for cutting through a web;

a backing cylinder;

a longitudinal sector-shaped portion on the periphery of said backing cylinder and aligned parallel to the axis of said backing cylinder, with suction holes for retaining the leading end of the new web behind the severing cut;

a first tape-applying cylinder, adapted to carry a tape which is adhesive on one side, and to apply the adhesive tape to the two webs at their abutting cut edges as they pass between the first tape applying cylinder and said backing cylinder;

means to move said backing cylinder into engagement with the new supply roll;

means for accelerating said new supply roll, said cutter cylinder and said backing cylinder to the same peripheral velocity as said exhausted supply roll;

controlling means for controlling the rotation of said backing cylinder and said new supply roll, so that said adhesive means engages said backing cylinder at a position other than at said sector-shaped portion, whereby a length of said leading end of said web is wrapped around the periphery of said backing cylinder and cut from the web of the new roll; and means for moving the cutter cylinder and the first tape-applying cylinder into and out of engagement with the common backing cylinder.

2. Apparatus according to claim 1, characterized in that a second tape-applying cylinder for carrying an adhesive tape is disposed on that side of the web which is opposite to the first tape-applying cylinder, which constitutes a backpressure cylinder cooperating with the second tape-applying cylinder.

3. Apparatus according to claim 1 or 2, characterized in that a drive roll is provided, which is movable into engagement with the new supply roll and adapted to accelerate the latter to the velocity of the web.

4. Apparatus according to claim 2, characterized in that the backing cylinder and the second tape-applying cylinder are vertically immovably mounted in the frame, and the first tape-applying cylinder is guided to be movable up and down in a plane that is centrally disposed between the backing cylinder and the second tape-applying cylinder and is adapted to be moved into engagement with both of them.

5. Apparatus according to claim 2, characterized in that the backing cylinders and the two tape-applying cylinders are rotatably mounted in a carriage, which is horizontally movable in the frame relative to the new supply roll.

6. Apparatus according to claim 1, characterized in that the cutter cylinder is driven to rotate at the same peripheral velocity as the backing cylinder, which has a cutting groove, and the cutter of the cutter cylinder and the cutting groove revolve in phase with each other.

7. Apparatus according to claim 2, characterized in that common means are provided for driving the backing cylinder and the tape-applying cylinders and comprise a differential for adjusting the phase relation of said cylinders.

8. Apparatus according to claim 3, characterized in that the means for driving the drive roller cooperating with the new supply roll are provided with a differential for changing the phase angle of said drive roll.

9. Apparatus according to claim 8, characterized in that the means for controlling the phase angles are provided with photosensors.

10. Apparatus according to claim 5, characterized in that the carriage is provided with a photoelectric detector for controlling the movement of the backing cylinder into engagement with the new supply roll.

11. An apparatus as claimed in claim 1, wherein said controlling means includes a first sensing means for detecting a phase angle of said new supply roll and a second sensing means for detecting a phase angle of said backing cylinder, said controlling means controlling the phase angles of said backing cylinder and said new supply roll based on the detected phase angles so that said adhesive means engages said backing cylinder at a position other than at said sector-shaped portion.

* * * * *